United States Patent [19]

Gustafson

[11] 4,240,260

[45] Dec. 23, 1980

[54] STEAM TREATING METHOD AND SYSTEM

[75] Inventor: Karl A. Gustafson, Njurunda, Sweden

[73] Assignee: SCA Development Aktiebolag, Sweden

[21] Appl. No.: 958,880

[22] Filed: Nov. 8, 1978

[30] Foreign Application Priority Data

Nov. 29, 1977 [SE] Sweden ..... 7713501

[51] Int. Cl.[3] ..... F01K 17/00

[52] U.S. Cl. ..... 60/670

[58] Field of Search ..... 60/644, 645, 648, 670

[56] References Cited

U.S. PATENT DOCUMENTS

| | | | |
|---|---|---|---|
| 3,972,196 | 8/1976 | Silvestri, Jr. | 60/670 |
| 3,992,884 | 11/1976 | Pacault | 60/645 |
| 4,138,852 | 2/1979 | Jackson | 60/670 |

*Primary Examiner*—Stephen A. Kreitman

*Attorney, Agent, or Firm*—Lerner, David, Littenberg & Samuel

[57] ABSTRACT

A method and apparatus are disclosed for compressing a portion of low pressure steam into steam of higher pressure in which the means for doing so are energized by the heat energy of the remainder of the low pressure steam.

9 Claims, 1 Drawing Figure

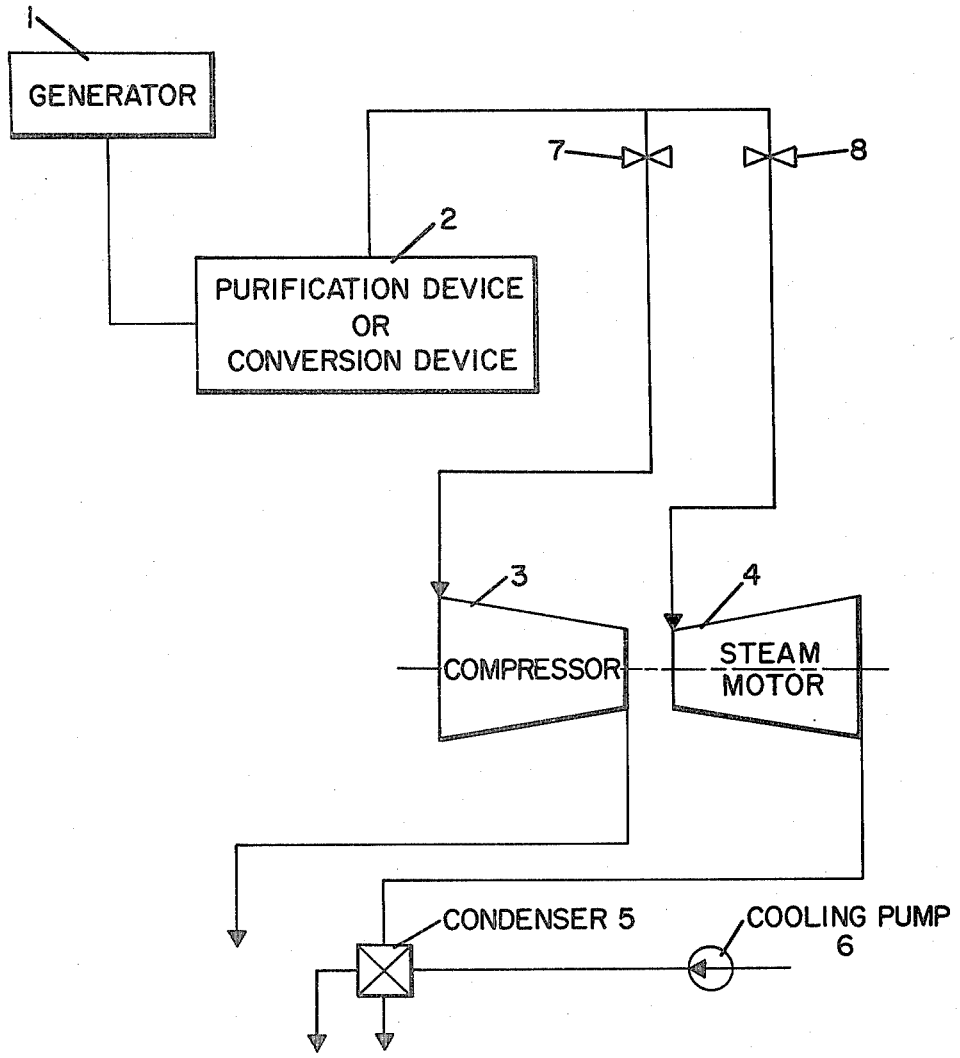
1
GENERATOR
7
8
2
PURIFICATION DEVICE
OR
CONVERSION DEVICE
3
4
COMPRESSOR
STEAM
MOTOR
CONDENSER 5
COOLING PUMP
6

STEAM TREATING METHOD AND SYSTEM

BACKGROUND OF THE INVENTION

The present invention relates to a method and apparatus for compressing low pressure steam into steam of higher pressure and temperature without the need for an external energy source. More particularly, the invention relates to a method and apparatus for compressing a portion of low pressure steam, e.g., steam generated by the refining of cellulose-containing materials, into steam of higher pressure and temperature employing the heat energy of the remainder of the low pressure steam.

Various industrial processes produce as a by-product large amounts of heat energy in the form of steam having low pressure and low temperature. Although this low pressure steam has a high heat energy content, many industrial applications for such steam require a higher pressure and temperature. Using an external energy source to compress the low pressure steam is sometimes impractical and costly. Thus, this low pressure steam, even with its high heat content, has a limited field of application. In fact, many times the low pressure steam is just discarded.

SUMMARY OF THE INVENTION

In accordance with the present invention, it has now been found that the energy content of low pressure steam can be utilized to produce steam of higher pressure and temperature without the need of any external energy source to compress the steam, resulting in a saving of energy and cost. This result is achieved by first dividing the low pressure steam into two steam flow paths, e.g., through conduits. The first steam flow is directed into a steam motor where the low pressure steam expands to drive the motor. The steam motor is operatively connected to a compressor such that the steam motor drives the compressor. The second steam flow is directed into the compressor where it is compressed to a desired final pressure. The division of the low pressure steam into two steam flow paths is controlled so that the first steam flow through the steam motor generates sufficient energy to compress the second steam flow to the desired final pressure.

More particularly, in accordance with the method of the present invention, low pressure steam is generated by a refiner in connection with the refining of cellulose-containing material. Since this low pressure steam often contains impurities, it is sometimes necessary to purify the steam prior to dividing it into two steam flows and subjecting it to compression. This purification can be achieved by any suitable purification device of the type well known in the art. Alternatively, rather than purifying the low pressure steam, it can be converted into purified low pressure steam by passing it through a heat exchanger in heat contact with suitably pure water. The heat of the low pressure steam converts the water into purified steam and this purified steam is then used in the process of the invention. Of course, if the low pressure steam does not contain an undesirable amount of impurities, purification or conversion devices are not needed.

As mentioned above, this low pressure steam is divided into two steam flow paths. The first steam flow is preferably passed through a first regulating means, e.g., a valve means, into a steam motor. The steam motor is preferably a turbine. The low pressure steam expands into an area of lower pressure in the steam motor thereby driving it.

This steam motor is operatively connected to a compressor so that the steam motor drives the compressor. In addition, the steam motor is normally connected to a condenser in order to condense the steam leaving the motor.

The second steam flow is passed through a second regulating means, e.g., a valve means, into the compressor where the steam is compressed to a predetermined final pressure. The distribution of the respective steam flows passing through the compressor and steam motor is controlled by the regulating means so that the first steam flow through the steam motor generates sufficient energy to compress the second steam flow passing through the compressor to the predetermined final pressure. This control preferably takes place automatically, for example, by making the steam flow through each regulating means dependent upon the pressure of the steam leaving the compressor.

If desired, the low pressure steam can be divided into more than two steam flow paths. For example, the low pressure steam could be divided into four steam flow paths, with two steam flows being directed to one steam motor-compressor combination, while the other two steam flows are directed to a second steam motor-compressor combination. Moreover, some of the low pressure steam from the steam generator may be used for other purposes and not involved in the utilization of the present invention.

Any suitable compressor and steam motor can be used in the present invention, e.g., conventional compressors and steam motors, such as piston engines. However, turbo machines are preferred, especially when large steam volumes are involved.

Of course, separate regulating means may not be needed. For example, one valve may also be used which divides the steam flow into two steam flow paths and also regulates the amount of steam flowing into each path.

The compressed steam generated by the process of the invention can be utilized for any suitable purpose, for example, to preheat the material to be refined in the refining of cellulose-containing material. The compressed steam can also be utilized, however, in some other functions in an installation, for example, for heating the drying rollers in a paper making machine or for driving an evaporation apparatus.

BRIEF DESCRIPTION OF THE DRAWINGS

The present invention is described in greater detail in the following detailed description which refers to the FIGURE showing a schematic representation of a process and system for compressing steam in accordance with the present invention.

DETAILED DESCRIPTION

Referring to the FIGURE, a steam generator 1 produces low pressure steam. This low pressure steam is passed from the generator 1, for example, through a conduit to a device 2 which can be either a purification device or a conversion device. The purification device (e.g., a cyclone-scrubber) removes impurities contained in the steam. In the conversion device, the low pressure steam is passed through a heat exchanger in heat contact with suitably pure water and the water is volatilized into purified low pressure steam. The purification or conversion device, of course, will not be needed when the low pressure steam from the generator 1 already is sufficiently pure.

The purified low pressure steam is then divided into two steam flow paths, e.g., by conduits. The first steam flow is directed through a first regulating means 8, e.g., a valve, to a steam motor 4, which is preferably a turbine. The steam motor 4 is driven by the low pressure steam expanding into an area of lower pressure within the steam motor. Upon leaving the steam motor, the steam is passed into a condenser 5 through which cooling water is pumped by a cooling pump 6. The steam motor 4 is operatively connected to a compressor 3 so that the steam motor drives the compressor.

The second steam flow is directed through a second regulating means 7, e.g., a valve, into the compressor 3 where the second steam flow is compressed to the desired final pressure.

The distribution of the low pressure steam flows into the compressor 3 and steam motor 4 is controlled by the regulating means 7 and 8 such that the first steam flow through the steam motor 4 generates sufficient energy to compress the second steam flow in the compressor 3 to the final desired pressure. The control of the regulating means 7 and 8 preferably takes place automatically and is determined by the pressure of the steam leaving the compressor.

The following example is intended to illustrate but not to limit the invention.

EXAMPLE

Two low pressure steam generators are operated so as to produce steam in amount of 10 tons per hour at 1.01 bar and 100° C. (Sample I) and 8.8 tons per hour at 2.0 bar and 120° C. (Sample II), respectively. In both instances, a pressure of 3.5 bar is chosen as the desired higher pressure for the steam.

With both Samples I and II, the low pressure steam flows are divided into two flow paths. One steam flow is passed through a valve into a compressor, while the other is passed through a valve into a turbine steam motor. The turbine is operatively coupled to the compressor so as to drive it. The respective steam flows through the valves are regulated so that the turbine generates sufficient energy to drive the compressor to compress the steam to 3.5 bar therein.

The efficiency rates of the compressor and turbine used in the present example were as follows:

Compressor: isentropic 0.75, mechanic 0.97.

Turbine: isentropic 0.65, mechanic 0.97.

The steam production rate, steam pressure, steam temperature, steam enthalpy, specific steam volume and total steam volume were measured at three locations in the above-described process, i.e., (1) at the conduit from the low pressure steam generator, (2) immediately after the compressor and (3) immediately after the turbine. The "effect coupling" was also measured at locations (1) and (2) above. "Effect coupling" is a measure of the power required to be generated by the turbine in order to drive the compressor to compress the steam to the final desired pressure. The results are set forth below in the table.

| | | Location 1 | | Location 2 | | Location 3 | |
|---|---|---|---|---|---|---|---|
| | Unit | Sample I | Sample II | Sample I | Sample II | Sample I | Sample II |
| Steam amount | t/h | 10 | 8.8 | 4.36 | 6.07 | 5.64 | 2.73 |
| Steam pressure | bar | 1.03 | 2.0 | 3.5 | 3.5 | 0.074 | 0.074 |
| Steam temperature | °C. | 100 | 120 | 267 | 193 | 40 | 40 |
| Steam enthalpy | MJ/t | 2676 | 2707 | 3001 | 2851 | 2425 | 2387 |
| Spec. steam volume | $m^3/kg$ | 1.673 | 0.886 | 0.7 | 0.6 | 19.0 | 18.5 |
| Total steam volume | $m^3/h$ | 16.7 $\times 10^3$ | 7.8 $\times 10^3$ | 3.0 $\times 10^3$ | 3.6 $\times 10^3$ | 107 $\times 10^3$ | 50.5 $\times 10^3$ |
| Effect coupling | KW | | | 405 | 250 | 405 | 250 |

These results demonstrate that the process of the present invention provides a conversion of low pressure steam to steam of higher temperature and pressure without the need for any external energy source, thus resulting in a savings of energy and cost.

It will be understood that the embodiments described above are merely exemplary and that persons skilled in the art may make many variations and modifications without departing from the spirit and scope of the invention. All such modifications and variations are intended to be included within the scope of the invention as defined by the appended claims.

What is claimed is:

1. A method of compressing low pressure steam which comprises dividing the low pressure steam into two steam flow paths, directing the first steam flow into a steam motor, in which steam motor said first steam flow is expanded so as to drive the steam motor, said steam motor being operatively connected to a compressor so that the steam motor drives the compressor, and directing the second steam flow into the compressor in which said second steam flow is compressed to a desired final pressure, said division into two steam flow paths being controlled so that the first steam flow through the steam motor generates sufficient energy to compress the second steam flow in the compressor to the desired final pressure.

2. A method according to claim 1, in which the low pressure steam is purified prior to being divided into two flow paths.

3. A method according to claim 1, in which the low pressure steam prior to being divided into two steam flow paths is converted into purified low pressure steam by a heat exchange process with purified water.

4. A method according to claim 1, in which the low pressure steam is produced by the refining of cellulose-containing material.

5. A method according to claim 1, in which the steam motor and compressor are both turbo machines.

6. A method according to claim 1 or 5, in which the steam flows through the steam motor and compressor are controlled by means of valves.

7. A method according to claim 1 or 5, in which the respective steam flows through steam motor and compressor are determined by the pressure of the steam leaving the compressor.

8. A system for compressing low pressure steam, comprising steam generating means for generating low pressure steam; compressing means, receiving a second portion of said low pressure steam from said steam generating means, for compressing said second portion of said low pressure steam to a predetermined higher pressure; driving means, receiving a first portion of said low pressure steam, for driving said compressor, said driving means being driven by the energy of said first portion of said low pressure steam; and a regulating means for regulating said first and second portions of said low pressure steam so that said driving means generates sufficient energy to drive said compressing means such that the compressing means compresses said second portion of said low pressure steam to said predetermined higher pressure.

9. The system according to claim 8, in which the compressing means and driving means are both turbo machines.

* * * * *